US006922014B2

(12) United States Patent
Oh et al.

(10) Patent No.: US 6,922,014 B2
(45) Date of Patent: Jul. 26, 2005

(54) FIELD EMISSION DISPLAY DEVICE HAVING CARBON-BASED EMITTERS

(75) Inventors: Tae-Sik Oh, Suwon (KR); Jong-Min Kim, Suwon (KR); Sang-Jin Lee, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 10/271,971

(22) Filed: Oct. 17, 2002

(65) Prior Publication Data

US 2004/0004429 A1 Jan. 8, 2004

(30) Foreign Application Priority Data

Jul. 3, 2002 (KR) ..... 2002-38217

(51) Int. Cl.[7] ..... H01J 1/62

(52) U.S. Cl. ..... 313/495; 313/309; 313/310; 313/336; 313/351

(58) Field of Search ..... 313/495, 309, 313/310, 336, 351

(56) References Cited

U.S. PATENT DOCUMENTS 5,552,659 A 9/1996 Macaulay et al.
6,057,637 A * 5/2000 Zettl et al. ..... 313/310
6,100,628 A * 8/2000 Coll et al. ..... 313/310

* cited by examiner

*Primary Examiner*—Vip Patel
(74) *Attorney, Agent, or Firm*—Stein, McEwen & Bui, LLP

(57) ABSTRACT

A field emission display includes a first substrate, cathode electrodes formed on the first substrate, conductive layers formed on the cathode electrodes having first apertures to expose portions of the cathode electrodes, an insulating layer formed on the conductive layers and having second apertures communicating with the first apertures, gate electrodes formed on the insulating layer and having third apertures communicating with the second apertures, emitters formed on the cathode electrodes and within the first apertures, a second substrate provided opposing the first substrate with a predetermined gap therebetween; and an anode layer formed on the second substrate, and phosphor layers formed on the anode electrode. In a first direction, second and third measurements of the second and third apertures are larger than a first measurement of the first apertures, and each of the emitters is realized in an integral unit.

38 Claims, 6 Drawing Sheets

FIELD EMISSION DISPLAY DEVICE HAVING CARBON-BASED EMITTERS

CROSS-REFERENCE TO RELATED APPLICATION

This application claims priority to and the benefit of Korean Application No. 2002-38217, filed on Jul. 3, 2002 in the Korean Intellectual Property Office, the disclosure of which is incorporated herein by reference.

BACKGROUND OF THE INVENTION

1. Field of the Invention

The present invention relates to a field emission display, and more particularly, to a field emission display having carbon-based emitters.

2. Description of the Related Art

A field emission display (FED) uses a cold cathode as the source for emitting electrons. The overall quality of the FED depends on the characteristics of emitters, which form an electron emission layer. In the initial FEDs, the emitters were formed of what are referred to as Spindt-type metal tips (or microtips). A main material of the metal tips is molybdenum (Mo).

However, in the FED having metal tip emitters, since (a) extremely fine holes in which the emitters are disposed must be formed in an insulating layer, and (b) the metal tips must be formed uniformly over the entire display area of the FED using the process of depositing molybdenum (MO), production is complicated. Further, not only is high technology needed, but expensive equipment is required for the manufacture of the FED such that unit costs are increased. Such factors make production of large screens of these types of FEDs difficult.

Accordingly, a great deal of research and development is being performed by those in industries related to FEDs to form emitters in a flat configuration that both enables electron emission at low voltages, and simplifies manufacture. It is known that carbon-based materials (e.g., graphite, diamond, DLC (diamond-like carbon), $C_{60}$ (Fullerene), or CNT (carbon nanotubes)), are suitable for use in the manufacture of planar emitters. In particular, it is believed that CNTs, with their ability to enable relatively low driving voltages, are the ideal material for emitters in field emission displays.

Typically during the manufacture of an FED having a triode structure including a cathode, an anode, and a gate electrode, the cathode electrodes are first formed on a substrate. An insulating layer having minute holes and gate electrodes are formed on the cathode electrodes. The emitters are then formed in the holes and over the cathode electrodes.

In the above triode structure, however, color purity deteriorates and the realization of sharp pictures is difficult during actual operation. This deterioration is caused by an increase in a divergent force on electron beams, which are formed of electrons emitted from the emitters. The divergent force is formed by a voltage (a positive voltage of a few to a few tens of volts) applied to the gate electrodes such that the electron beams do not travel along their intended paths. Therefore, the electron beams land not only on intended phosphor layers, but also on unintended phosphor pixels of the wrong color to illuminate the same.

To overcome this problem, there are efforts to minimize the diffusion of the electron beams by decreasing an area of the emitters corresponding to each of the phosphor pixels. However, there are limitations as to how small the emitters can be formed and still realize good formation. Also, when the whole area of the emitters are formed excessively small, there is a reduction in the ability to focus the electron beams to within the phosphor pixels.

Alternatively, to prevent the problem of excessive diffusion of the electron beams, there have been attempts to form separate electrodes for electron beam focusing in peripheral portions of the gate electrodes. However, there are limited effects when the FED has emitters of the microtip. Further, there are inherent problems during manufacture as a result of the microtip formation of the emitters.

U.S. Pat. No. 5,552,659 discloses an electron emitting source structure in which a ratio between a thickness of a non-insulating layer and a dielectric layer, which are formed on a substrate on which emitters are provided, and a ratio between a diameter of holes formed passing through the non-insulating layer, the dielectric layer, and a gate layer, which is formed on the dielectric layer, and the thickness of the non-insulating layer are limited to reduce the divergence of electron beams. In this device, a plurality of electron emitting sources is minutely formed within a plurality of the holes, each pair of electron emitting sources and holes being formed corresponding to one pixel. Accordingly, manufacture is difficult due to the extremely complicated structure. Also, since there are structural restrictions as to space during actual manufacturing, there are limits to maximizing the number and area of the emitters corresponding to each pixel such that it is difficult to realize a high resolution of the FED. In addition, because of the increasing load after being operated for long periods, the life reliability of the FED is reduced.

SUMMARY OF THE INVENTION

An object of the present invention is to provide a field emission display that minimizes diffusion of electron beams generated by electron emitting sources while having a simple structure of the electron emitting sources.

Additional objects and advantages of the invention will be set forth in part in the description which follows and, in part, will be obvious from the description, or may be learned by practice of the invention.

To achieve the above and other objects, an embodiment of the present invention provides a field emission display including a first substrate; cathode electrodes formed on the first substrate in a predetermined pattern; conductive layers formed on each of the cathode electrodes, adjacent pairs of the conductive layers having corresponding first apertures, each of the first apertures defining an exposed portion of one of the cathode electrodes; an insulating layer formed on the conductive layers and having second apertures, each of the second apertures connecting to a corresponding one of the first apertures; gate electrodes formed on the insulating layer and having third apertures, each of the third apertures connecting to a corresponding one of the second apertures; emitters formed on the cathode electrodes, each of the emitters being within a corresponding one of the first apertures; a second substrate provided facing the first substrate with a predetermined gap therebetween and forming a vacuum container with the first substrate within the predetermined gap; an anode layer formed on a surface of the second substrate opposite the first substrate; and phosphor layers formed on the anode electrode in a predetermined pattern.

According to an aspect of the invention, each of the second apertures and the corresponding one of the third apertures are larger than the corresponding one of the first apertures when measured in a first direction.

According to an additional aspect of the invention, each of the emitters is realized in a single, integral unit.

According to another aspect of the invention, ones of the conductive layers are formed along two opposing edges of a corresponding one of the cathode electrodes and each of the first apertures are formed over the corresponding one cathode electrode between the ones of the conductive layers.

According to a yet additional aspect of the invention, the conductive layers are opaque.

According to yet another aspect of the invention, when measured in a second direction, each of the second apertures has the same size as the corresponding one of the third apertures.

According to still another aspect of the invention, the first apertures, the second apertures, the third apertures, and the emitters are substantially rectangular with widths in a first direction and lengths in a second direction.

According to still yet another aspect of the invention, the phosphor layers comprise R,G,B phosphors that are substantially rectangular with widths in the first direction and lengths in the second direction.

According to further aspect of the invention, a plurality of the emitters is formed for each pixel of the field emission display, in which case the gate electrodes are separated to correspond to the plurality of the emitters.

According to an aspect of the invention, no more than one said emitter is disposed at each pixel area.

BRIEF DESCRIPTION OF THE DRAWINGS

The accompanying drawings, which are incorporated in and constitute a part of the specification, illustrate embodiments of the invention, and, together with the description, serve to explain the principles of the invention.

DETAILED DESCRIPTION OF THE EMBODIMENTS

Figure 1:
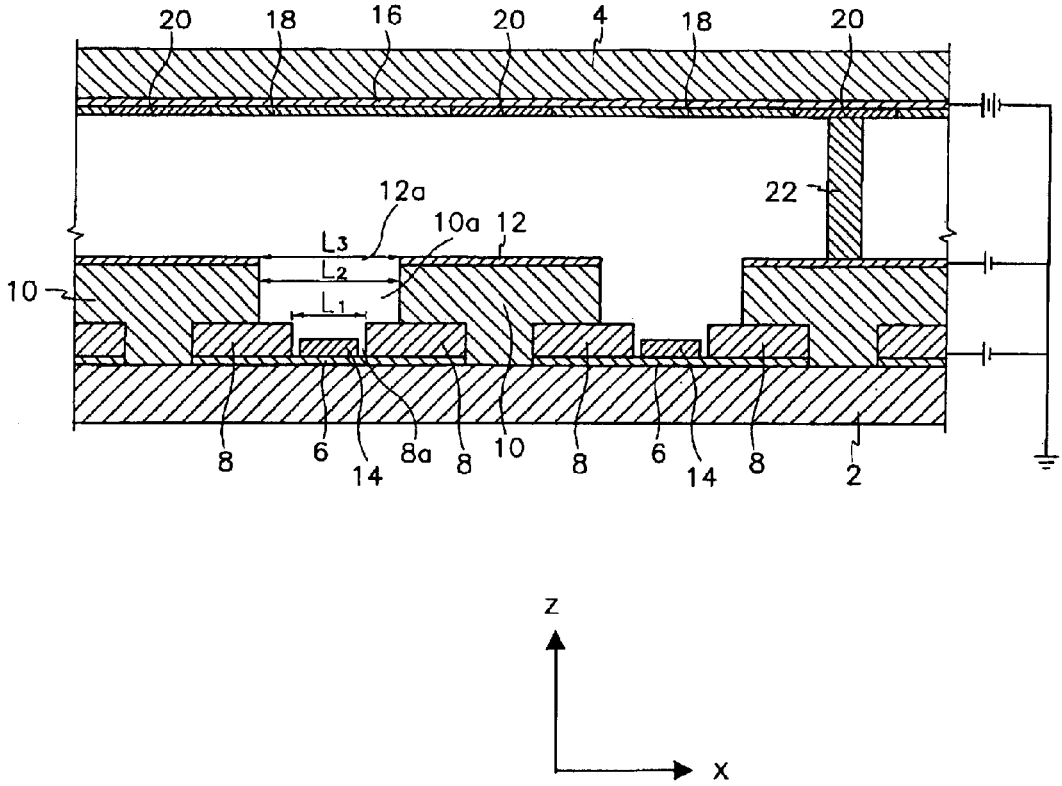
FIG. 1 is partial sectional view of a field emission display according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
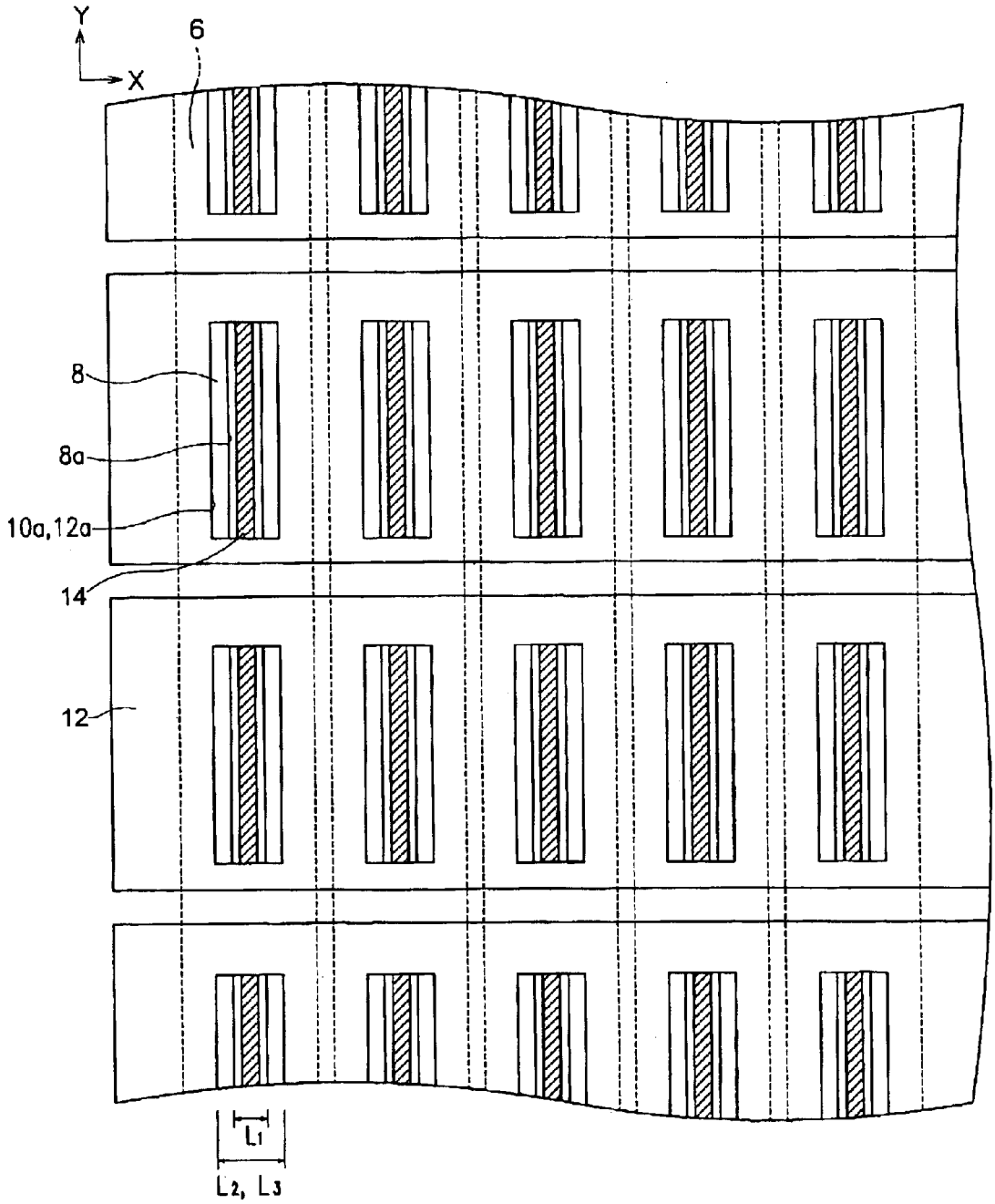
FIG. 2 is a partial plan view of the field emission display of FIG. 1.

FIG. 1 is partial sectional view of a field emission display according to an embodiment of the present invention, and FIG. 2 is a partial plan view of the field emission display of FIG. 1 used to describe structural elements formed on one of two substrates 2, 4. With reference to the drawings, the field emission display (FED) includes a first substrate (hereinafter referred to as a lower glass substrate) 2, and a second substrate (hereinafter referred to as an upper glass substrate) 4 provided substantially parallel to the lower glass substrate 2 with a predetermined gap therebetween. The lower glass substrate 2 and the upper glass substrate 4 define an exterior of the FED and a vacuum is formed therebetween.

A structure to enable the generation of an electric field is provided on the lower glass substrate 2 and a structure to enable the realization of predetermined images by electrons emitted as a result of the generated electric field is provided on the upper glass substrate 4. Specifically, a plurality of cathode electrodes 6 is formed on the lower glass substrate 2. Each cathode electrode 6 extends lengthwise in a Y direction, and adjacent cathode electrodes 6 are separated in the X direction at predetermined intervals to result in a predetermined pattern (e.g., a striped pattern). Further, a pair of opaque conductive layers 8 is formed on long edge portions of each of the cathode electrodes 6. The conductive layers 8 electrically communicate with the cathode electrodes 6. First apertures 8*a* are formed between corresponding pairs of the conductive layers 8. Each first aperture 8*a* has a measurement L1 in the X direction, which is perpendicular to the Y direction. In the shown embodiment of the present invention, each set of one of the cathode electrodes 6 and the corresponding conductive layers 8 formed thereon functions as one cathode electrode line. It is understood that the conductive layers 8 can also be formed by etching the first aperture 8*a* in the cathode electrode 6 so as to form a channel shape such that the conductive layers 8 remain a predetermined height above a middle portion of the cathode electrode 6 on which an emitter 14 is disposed.

An insulating layer 10 is formed in a predetermined pattern over an entire surface of the lower glass substrate 2 covering portions of the conductive layers 8. In more detail, as shown in FIG. 1, the insulating layer 10 partially covers the conductive layers 8 such that spaces between adjacent conductive layers 8 are covered by the insulating layer 10. The insulating layer 10 has a sufficient thickness to ensure that it provides enough insulation to electrically separate the gate electrodes 12 from the conductive layers 8. While not shown, it is understood that the conductive layer 8 need not be covered by the insulating layer 10 and instead can be a structure extending from a sidewall of the insulating layer 10 above the cathode electrode 6.

A plurality of second apertures 10*a*, each of which connects to one of the first apertures 8*a*, is formed in the insulating layer 10. In the shown embodiment of the present invention, the second apertures 10*a* are substantially rectangular, each having a long side along the Y direction and a short side along the X direction as shown in FIG. 2. The widths of the second apertures 10*a* along the X direction have a measurement L2, which is greater than the measurement L1 of the first apertures 8*a* in the X direction.

A plurality of gate electrodes 12 is formed on the insulating layer 10. Third apertures 12*a*, which are shown as being identical in shape and size to the corresponding second apertures 10*a*, are formed in the gate electrodes 12. Each of the third apertures 12*a* connects to one the second apertures 10*a* and one of the first apertures 8*a*. The gate electrodes 12 are formed at predetermined intervals to result in a striped pattern along the X direction.

Further, flat emitters 14, each having a thickness less than that of the conductive layers 8, are formed on the cathode electrodes 6 within the first apertures 8*a*. The emitters 14 emit electrons through corresponding apertures 8*a*, 10*a*, 12*a* as a result of the formation of electric fields due to voltages applied to the cathode electrodes 6, the conductive layers 8, and the gate electrodes 12. In the shown embodiment of the present invention, the emitters 14 are made of a carbon-based material, particularly, carbon nanotubes. However, other types of materials can be used including, but not limited to graphite, diamond, DLC, and $C_{60}$.

In addition, the emitters 14 are realized as single, integral structures in each of the first apertures 8*a*. A shape of the emitters 14 is similar to that of the second and third apertures 10*a* and 12*a*. Specifically, the emitters 14 are substantially rectangular with long sides along the Y direction and short sides along the X direction. However, it is understood that the emitters 14 can have other shapes and need not be single, integral structures in all aspects of the invention.

During manufacture of the FED, according to an aspect of the invention, the emitters 14 are formed using a photoresist process using a photosensitive carbon nanotube paste. Exposure for the formation of the emitters 14, with reference to FIG. 1, is performed in a direction toward the emitters 14 from outside the lower glass substrate 2 (i.e., in a negative Z direction). At this time, the opaque conductive layers 8 are used as a mask to pattern the emitters 14. The present invention is not limited to the above method of forming the emitters 14, and it is possible to use other methods, such as an etching method or a plating method.

With respect to the upper glass substrate 4 disposed opposite to the lower glass substrate 2 as described above, an anode electrode 16 made of ITO is formed on a surface of the upper glass substrate 4 opposite the lower glass substrate 2. Phosphor layers 18, formed of R,G,B phosphors, are provided on the anode electrode 16 and are exposed to the gap between the substrates 2, 4. In the shown embodiment of the present invention, the R,G,B phosphors forming the phosphor layers 18 extend along the Y direction corresponding to the cathode electrodes 6 in substantially rectangular patterns.

Further, a black matrix 20 is formed on the upper glass substrate 4 between the phosphor layers 18. The black matrix 20 improves contrast. In addition, a metal thin film layer (not shown) made of aluminum or other such material is formed on the phosphor layers 18 and the black matrix 20. The metal thin film layer helps to improve a voltage withstanding property and brightness characteristics of the FED.

The lower glass substrate 2 and the upper glass substrate 4 are arranged with a predetermined gap therebetween and such that the emitters 14 oppose the phosphor layers 18, both of which are exposed to the gap. A frit (not shown) is provided at circumferential edge portions of the lower and upper glass substrates 2 and 4 to attach these elements to each other, thereby forming an integral unit. Spacers 22 are provided at non-pixel regions between the substrates 2 and 4 to maintain the predetermined gap.

In the FED structured as in the above embodiment, predetermined external voltages are applied to the cathode voltages 6, the gate electrodes 12, and the anode electrode 16. For instance, a negative voltage of a few to a few tens of volts is applied to the cathode electrodes 6, a positive voltage of a few to a few tens of volts is applied to the gate electrodes 12, and a positive voltage a few hundred to a few thousand volts is applied to the anode electrode 16. As a result, electric fields are formed between the gate electrodes 12, the conductive layers 8, and the cathode electrodes 6 such that electrons are emitted from the emitters 14. The electrons form electron beams which are induced toward the phosphor layers 18 to land on the same. The phosphor layers 18 are illuminated to realize predetermined images.

Figure 3:
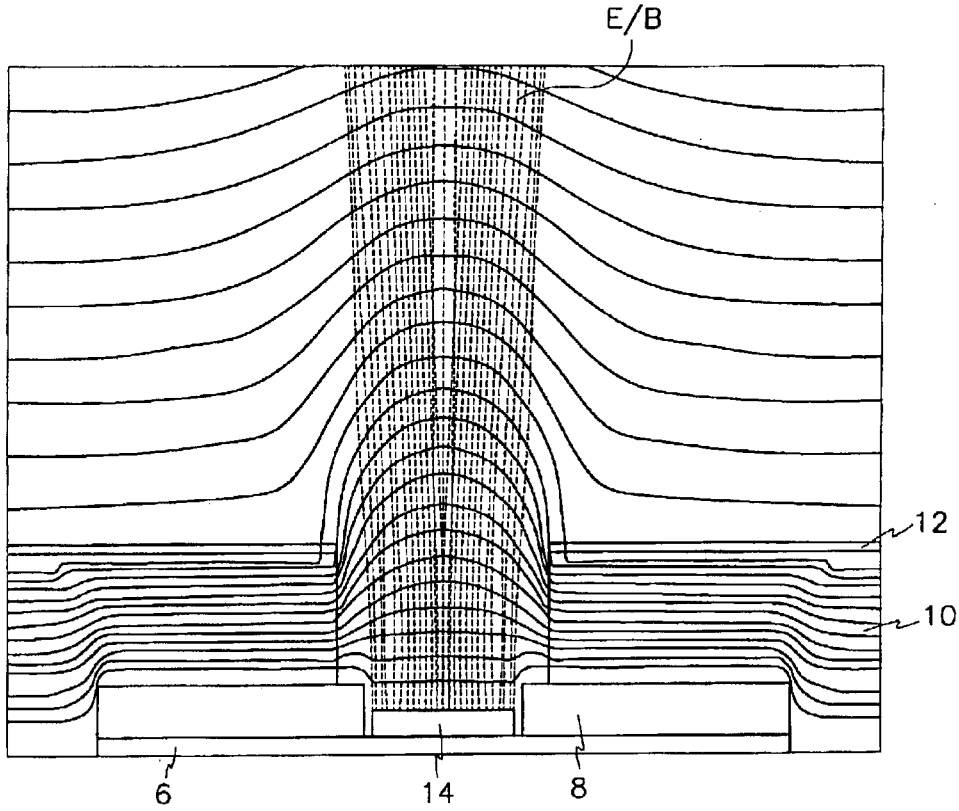
FIG. 3 is a drawing showing results of a computer simulation that enables traces of electron beams emitted from emitters of the field emission display of FIG. 1 to be viewed.

During operation of the FED, when electron beams formed by electrons emitted from edges of the emitters 14 travel toward the phosphor layers 18, the conductive layers 8 prevent the dispersion of these electron beams. FIG. 3 is a drawing showing results of a computer simulation with respect to the FED structured as in the above. A trajectory of the electron beams emitted from the emitters 14 toward the phosphor layers 18 may be viewed in the drawing.

Figure 4:
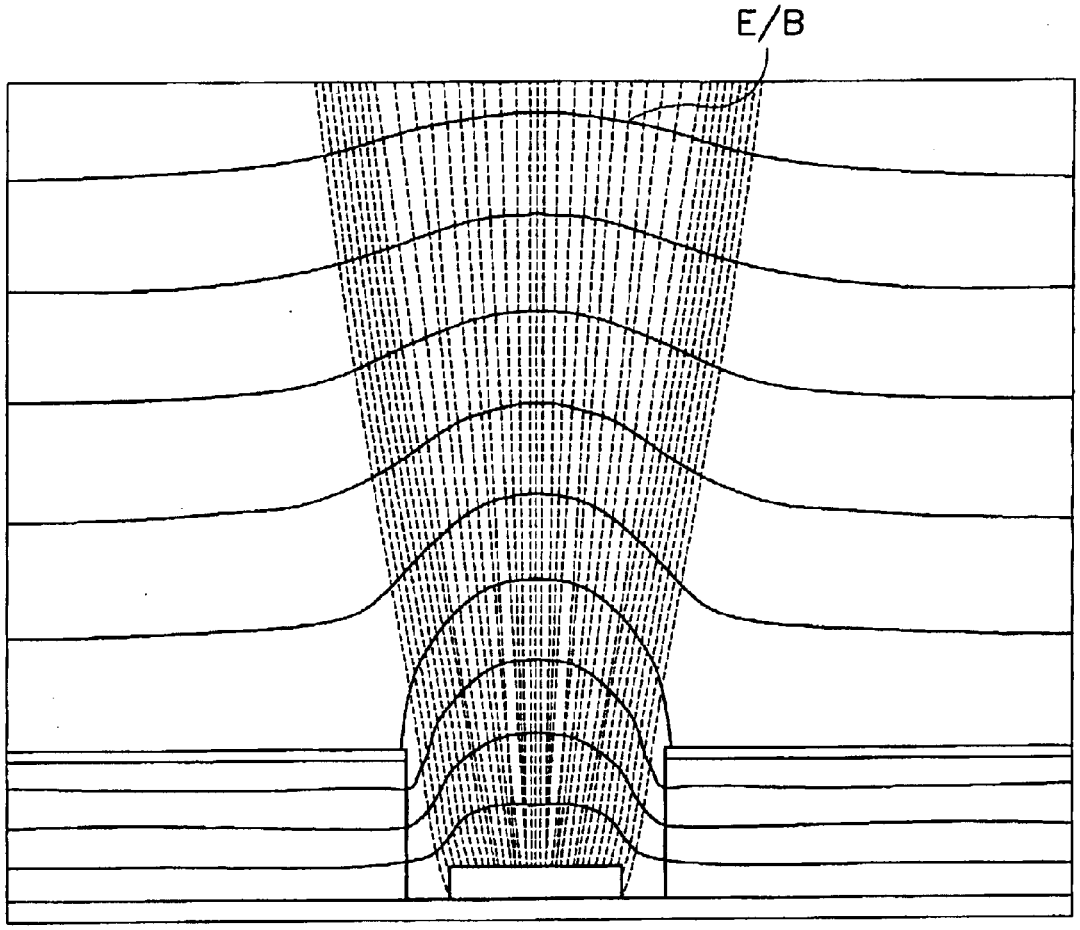
FIG. 4 (PRIOR ART)
FIG. 4 is a drawing showing results of a computer simulation that enables traces of electron beams emitted from emitters of a comparative example of the present invention to be viewed.

As shown in FIG. 3, the electron beams E/B emitted from the emitters 14 are minimally diverged in directions parallel to the substrates 2 and 4. This is evident particularly when compared with the highly diverged electron beams E/B of the prior art FED shown in FIG. 4. The conventional FED of FIG. 4 does not include conductive layers, and the emitters are minutely structured and are not provided as an integral structure with respect to each pixel.

As described above, the minimal divergence of the electron beams is realized by the pairs of the conductive layers 8 provided for each emitter 14. That is, as a result of the electric fields formed by the conductive layers 8 disposed at long edge portions of the emitters 14, the dispersion of the electron beams is prevented. As a result, the electron beams emitted from the emitters 14 do not land on unintended phosphor layers 18 of a different color and instead are better converged toward their intended phosphor layer 18 to illuminate the same.

Figure 5:
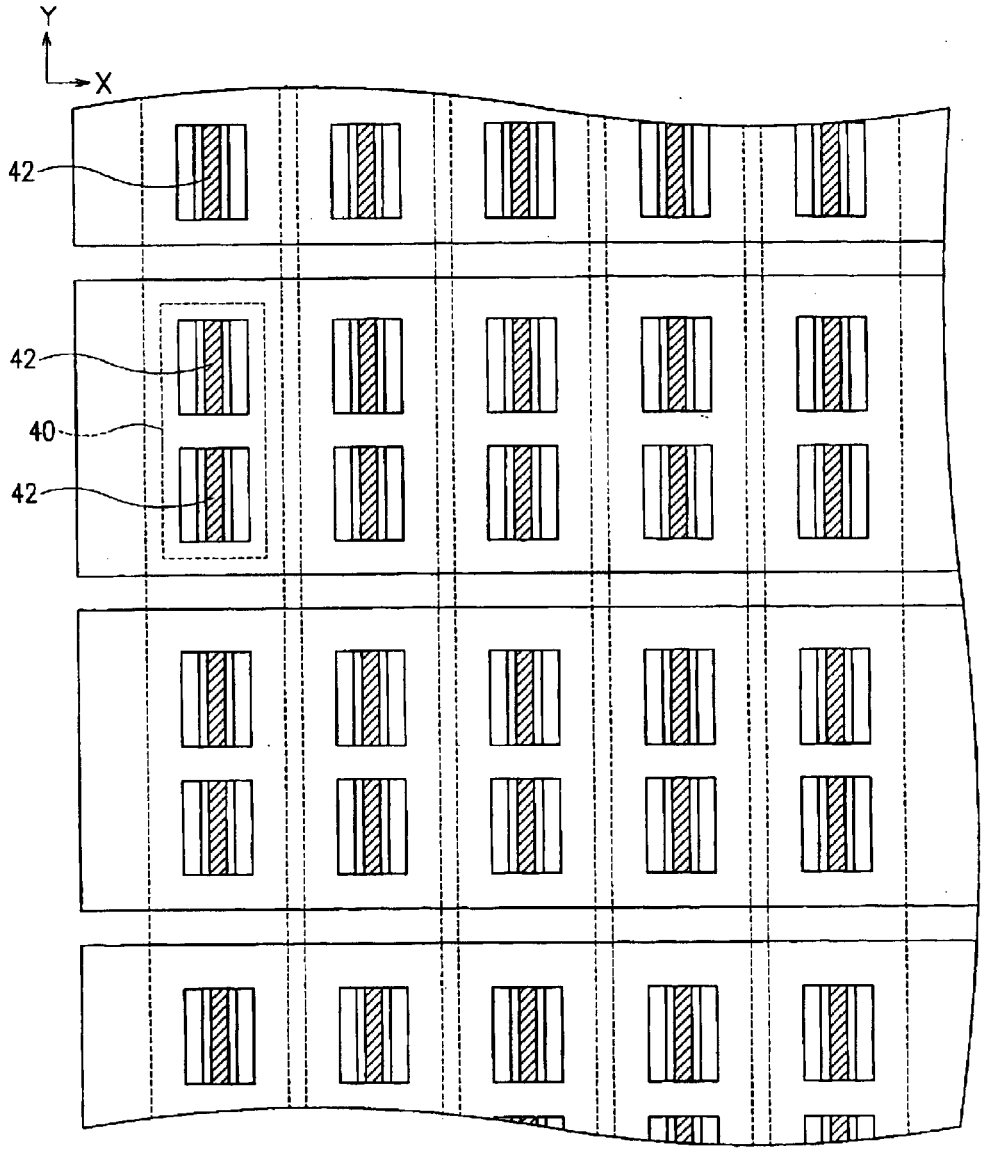
FIG. 5 is a partial plan view of a field emission display according to another embodiment of the present invention.

FIG. 5 is a partial plan view of an FED according to another embodiment of the present invention. In the FED shown in FIG. 5, emitters 42, unlike the emitters 14 shown in FIG. 2, are separated for each pixel 40 into a predetermined number of sections. For the shown example, two sections are formed for each pixel 40. Except for this structure of separating the emitters 42 into a predetermined number of sections, all the FED shown in FIG. 5 are identical to the FED shown in FIGS. 1 and 2. Therefore, a description of the identical structure will not be provided.

Figure 6:
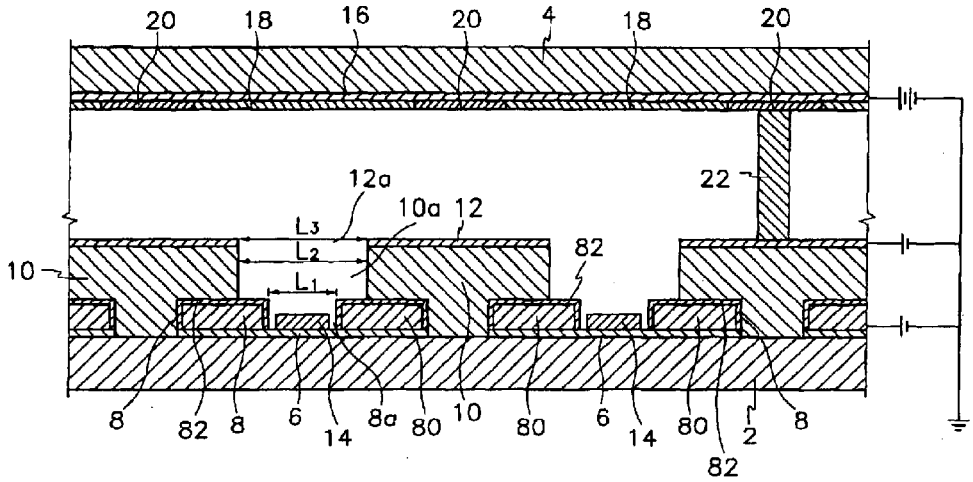
FIG. 6 is a partial sectional view of a field emission display according to a further embodiment of the present invention.

According to another embodiment of the present shown in FIG. 6, each of the conductive layers 8 includes an opaque insulating layer 80 and a thin metal layer 82 formed on the surface of the insulating later 80. In the above structure, the conductive layers 8 can accomplish basic functions as a conductive layer because of the metal layer 82, and they can prevent the conductive layer 8 from being incompletely formed due to an effect of an etching liquid during the etching process used to form holes on the insulating layer 10, because the metal layer 82 plays the part of a protective layer against the etching liquid.

Figure 7:
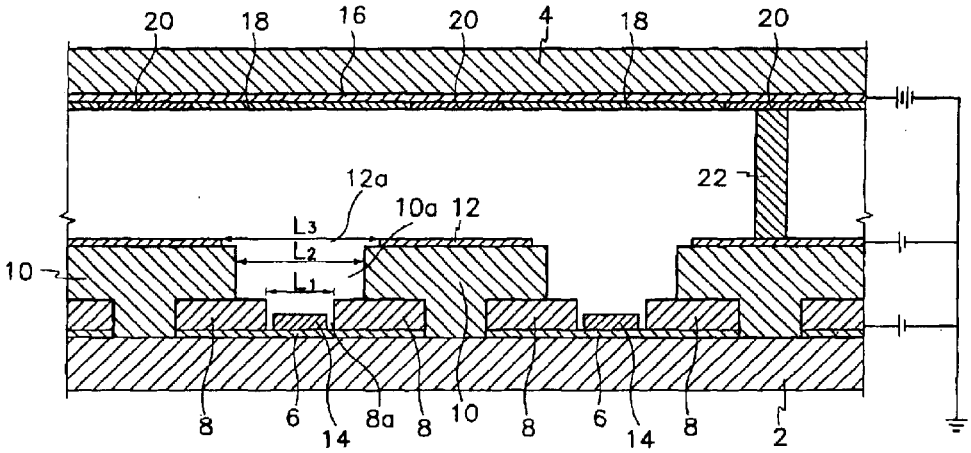
FIG. 7 is a partial sectional view of a field emission display according to a still further embodiment of the present invention.

Also, in the embodiment shown in FIG. 7, the second measurement L2 of the second aperture 10*a* is less than the third measurement L3 of the third aperture 12*a*. If the field emission display of the present invention has such a relationship between the apertures, since it can increase a route between the cathode electrodes 6 and the gate electrodes 12, the field emission display may have an advantage of improved voltage-withstanding properties.

In the FED of the present invention structured as in the above embodiments, the structure of forming the emitters on the cathode electrodes corresponding to the pixel regions is simple, and the electron beams formed by the emission of electrons from the emitters land only on intended phosphor layers. As a result, color purity is not degraded due to electron beams landing on unintended phosphor layers of the wrong color. Also, with such a single, integral structure of the emitters, a large quantity of electrons are better directed toward intended phosphor layers, thereby enabling the realization of a high picture quality. In addition, because of the relatively large area of the emitters, a long life reliability of the emitters is ensured even when the FED is operated for lengthy periods. Also, with the separated structure of the emitters for each of the pixels, high resolution is ensured.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A field emission display, comprising:

a first substrate;

cathode electrodes formed on said first substrate in a predetermined pattern;

conductive layers formed on said cathode electrodes, corresponding pairs of said conductive layers forming first apertures;

an insulating layer on said conductive layers and having second apertures;

gate electrodes formed on said insulating layer and having third apertures, each of the third apertures connecting to one of the first apertures through one of the second apertures so as to expose a portion of one of said cathode electrodes;

emitters formed on corresponding said cathode electrodes, each of said emitters being on the corresponding exposed portion within a corresponding one of the first apertures;

a second substrate provided opposite to said first substrate with a predetermined gap therebetween and forming a vacuum container with said first substrate in the predetermined gap;

an anode layer formed on a surface of said second substrate opposite said first substrate; and phosphor layers formed on said anode layer in a predetermined pattern so as to be exposed to the vacuum container in the predetermined gap, wherein:

each of the second apertures and a corresponding one of the third apertures are larger than a corresponding one of the first apertures when measured in one direction.

2. The field emission display of claim 1, wherein said conductive layers are opaque.

3. The field emission display of claim 1, wherein the sizes of the second apertures and the third apertures are identical when measured in another direction.

4. The field emission display of claim 1, wherein a size of each of the second apertures is less than a size of the corresponding third aperture when measured in the one direction.

5. The field emission display of claim 1, wherein said emitters comprise carbon nanotubes.

6. The field emission display of claim 1, wherein a plurality of said emitters comprise a pixel of the field emission display.

7. The field emission display of claim 6, wherein said gate electrodes are separated to correspond to the plurality of said emitters.

8. The field emission display of claim 1, wherein each of the first apertures includes only a corresponding one of said emitters.

9. The field emission display of claim 1, wherein no more than one said emitter is disposed at each pixel area.

10. The field emission display of claim 1, wherein:

each said emitter has a surface from which electrons are emitted towards a corresponding phosphor layer, and the surface of each said emitter is disposed at a height above the corresponding cathode electrode and has a shape that is substantially similar to a shape of a corresponding one of the first, second, or third aperture.

11. A field emission display, comprising:

a first substrate;

cathode electrodes formed on said first substrate in a predetermined pattern;

conductive layers formed on said cathode electrodes, corresponding pairs of said conductive layers forming first apertures;

an insulating layer on said conductive layers and having second apertures;

gate electrodes formed on said insulating layer and having third apertures, each of the third apertures connecting to one of the first apertures through one of the second apertures so as to expose a portion of one of said cathode electrodes;

emitters formed on corresponding said cathode electrodes, each of said emitters being on the corresponding exposed portion within a corresponding one of the first apertures;

a second substrate provided opposite to said first substrate with a predetermined gap therebetween and forming a vacuum container with said first substrate in the predetermined gap;

an anode layer formed on a surface of said second substrate opposite said first substrate; and phosphor layers formed on said anode layer in a predetermined pattern so as to be exposed to the vacuum container in the predetermined gap, wherein:

ones of said conductive layers are formed along two opposite edges of a corresponding one of said cathode electrodes so as to have corresponding surfaces extending into the corresponding second apertures without being covered by the corresponding insulating layers, and each of the first apertures is formed over said corresponding one cathode electrode between the ones of said conductive layers.

12. A field emission display, comprising:

a first substrate;

cathode electrodes formed on said first substrate in a predetermined pattern;

conductive layers formed on said cathode electrodes, corresponding pairs of said conductive layers forming first apertures;

an insulating layer on said conductive layers and having second apertures;

gate electrodes formed on said insulating layer and having third apertures, each of the third apertures connecting to one of the first apertures through one of the second apertures so as to expose a portion of one of said cathode electrodes;

emitters formed on corresponding said cathode electrodes, each of said emitters being on the corresponding exposed portion within a corresponding one of the first apertures;

a second substrate provided opposite to said first substrate with a predetermined gap therebetween and forming a vacuum container with said first substrate in the predetermined gap;

an anode layer formed on a surface of said second substrate opposite said first substrate; and phosphor layers formed on said anode layer in a predetermined pattern so as to be exposed to the vacuum container in the predetermined gap, wherein:

said conductive layers each comprise:

an opaque insulating layer formed on said cathode electrodes without covering the corresponding first aperture, and a thin metal layer formed on a surface of the insulating layer.

13. A field emission display, comprising:

a first substrate;

cathode electrodes formed on said first substrate in a predetermined pattern;

conductive layers formed on said cathode electrodes, corresponding pairs of said conductive layers forming first apertures;

an insulating layer on said conductive layers and having second apertures;

gate electrodes formed on said insulating layer and having third apertures, each of the third apertures connecting to one of the first apertures through one of the second apertures so as to expose a portion of one of said cathode electrodes;

emitters formed on corresponding said cathode electrodes, each of said emitters being on the corresponding exposed portion within a corresponding one of the first apertures;

a second substrate provided opposite to said first substrate with a predetermined gap therebetween and forming a vacuum container with said first substrate in the predetermined gap;

an anode layer formed on a surface of said second substrate opposite said first substrate; and phosphor layers formed on said anode layer in a predetermined pattern so as to be exposed to the vacuum container in the predetermined gap, wherein:

the first apertures, the second apertures, the third apertures, and said emitters are substantially rectangular with widths in a first direction being less than lengths in a second direction.

14. The field emission display of claim 13, wherein said phosphor layers comprise R,G,B phosphors that are substantially rectangular with widths in the first direction and lengths in the second direction.

15. The field emission display of claim 14, wherein:

each said emitter has a surface from which electrons are emitted towards a corresponding phosphor layer, and the surface of each said emitter is disposed at a height above the corresponding cathode electrode and has a shape that is substantially similar to a shape of a corresponding one of the first, second, or third aperture.

16. A field emission display, comprising:

a first substrate;

cathode electrodes formed on said first substrate in a predetermined pattern;

conductive layers formed on corresponding said cathode electrodes, adjacent pairs of said conductive layers forming first apertures therebetween;

an insulating layer formed on said cathode electrodes and having second apertures;

gate electrodes formed on said insulating layer and having third apertures, each of the third apertures connecting to one of the first apertures through one of the second apertures so as to expose a portion of a corresponding one of said cathode electrodes;

emitters formed on corresponding said cathode electrodes, each of said emitters being on the corresponding exposed portion within one of the first apertures;

a second substrate provided opposite said first substrate with a predetermined gap therebetween and forming a vacuum container with the first substrate; and an anode layer formed on a surface of said second substrate opposite said first substrate, and phosphor layers formed on said anode layer in a predetermined pattern so as to be exposed to the vacuum container in the predetermined gap, wherein:

a corresponding one of the third apertures is larger than a corresponding one of the first apertures when measured in a first direction, and each of said emitters comprises a single, integral unit.

17. The field emission display of claim 16, wherein said emitters comprise carbon nanotubes.

18. The field emission display of claim 16, wherein each of the first apertures includes only a corresponding one of said emitters.

19. The field emission display of claim 16, wherein no more than one said emitter is disposed at each pixel area.

20. The field emission display of claim 16, wherein:

each said emitter has a surface from which electrons are emitted towards a corresponding phosphor layer, and the surface of each said emitter is disposed at a height above the corresponding cathode electrode and has a shape that is substantially similar to a shape of a corresponding one of the first, second, or third aperture.

21. A field emission display, comprising:

a first substrate;

cathode electrodes formed on said first substrate along a second direction, said cathode electrodes being separated at predetermined intervals in a first direction to realize a striped pattern;

opaque conductive layers formed on corresponding said cathode electrodes, adjacent pairs of said conductive layers being along opposing edges of a corresponding one of said cathode electrodes so as to form a first aperture being formed by therebetween;

an insulating layer formed on said cathode electrodes at a predetermined thickness and having second apertures, each of the second apertures being larger in a first direction than one of the first apertures to which the second aperture is connected;

gate electrodes formed along the first direction perpendicular to the second direction separated at predetermined intervals in the second direction on said insulating layer to realize a striped pattern, said gate electrodes having third apertures, and each of the third apertures connects to a corresponding one of the first apertures through one of the second apertures so as to expose a portion of a corresponding one of said cathode electrodes;

emitters on the corresponding said cathode electrodes, each of said emitters being on the corresponding exposed portion of one of said cathode electrodes within one of the first apertures, said emitters being substantially rectangular with lengths in the second direction and widths in the first direction and which are less than the lengths;

a second substrate provided opposite said first substrate with a predetermined gap therebetween and forming a vacuum container with said first substrate in the predetermined gap;

an anode layer formed on a surface of said second substrate opposite said first substrate; and phosphor layers comprising R,G,B phosphors formed in substantially rectangular shapes with lengths in the second direction and on said anode layer corresponding to each of said emitters so as to be exposed to the vacuum contained in the predetermined gap.

22. The field emission display of claim 21, wherein said emitters comprise carbon nanotubes.

23. The field emission display of claim 21, wherein each of the first apertures includes only a corresponding one of said emitters.

24. The field emission display of claim 21, wherein no more than one said emitter is disposed at each pixel area.

25. The field emission display of claim 21, wherein each said emitter has a surface from which electrons are emitted towards a corresponding phosphor layer, and the surface of each said emitter is disposed at a height above the corresponding cathode electrode and has a shape that is substantially similar to a shape of a corresponding one of the first, second, or third aperture.

26. A field emission display, comprising:

a first substrate;

cathode electrodes formed on said first substrate along a second direction, adjacent pairs of said cathode electrodes being separated at predetermined intervals, each said cathode electrode having conductive protrusions extending from a surface of said cathode electrode so as to extend above a middle portion of the surface such that, when current passes through said cathode electrode, an electrical field is formed between the conductive protrusions above the middle portion;

an insulating layer disposed above said cathode electrodes without covering the conductive protrusions and the middle portions;

gate electrodes formed along a first direction on said insulating layer so as to form pixel areas with corresponding said cathode electrodes, adjacent pairs of said gate electrodes being separated at predetermined intervals;

emitters disposed on the middle portions between the conductive protrusions of said cathode electrodes at the corresponding pixel areas;

a second substrate provided opposite said first substrate so as to form a gap therebetween;

an anode layer formed on a surface of said second substrate opposite said first substrate; and phosphor layers formed on said anode layer above corresponding said emitters.

27. The field emission display of claim 26, wherein:

each of the apertures in said insulating layer and said gate electrodes have sidewalls surrounding one of the middle portions at a pixel area, and each of the conductive protrusions extends from the sidewalls in the first direction so as to be exposed to the gap between said first and second substrates.

28. The field emission display of claim 27, wherein:

each middle portion extends a first distance in the first direction between corresponding pairs of the conductive protrusions, and the sidewalls corresponding to each middle portion are separated in the first direction by a second distance which is greater than the first distance.

29. The field emission display of claim 28, wherein:

each of the apertures comprises a gate electrode aperture extending through one of said gate electrodes and an insulating layer aperture extending through said insulating layer, and each gate electrode aperture has a width in the first direction greater than a width of the corresponding insulating layer aperture in the first direction so as to expose a portion of said insulating layer to the gap between said first and second substrates.

30. The field emission display of claim 29, wherein the top surface of each said emitter is rectangular shaped with a length in the second direction.

31. The field emission display of claim 29, wherein the middle portion for each pixel area includes ones of said emitters separated in the second direction.

32. The field emission display of claim 31, wherein each pixel area has ones of the apertures, and each of the apertures corresponds to one of said emitters.

33. The field emission display of claim 26, wherein a top surface of each said emitter is exposed to the gap and is longer in the second direction than in the first direction.

34. The field emission display of claim 26, wherein no more than one said emitter is disposed at each pixel area.

35. The field emission display of claim 26, wherein no more than two of said emitters are disposed at each pixel area.

36. The field emission display of claim 26, wherein each conductive protrusion further comprises a conductive portion extending under said insulating layer so as to be disposed between said insulating layer and the corresponding cathode electrode.

37. The field emission display of claim 26, wherein each conductive protrusion comprises a non-conductive portion extending from said insulating layer, and a conductive layer coating the non-conductive portion and electrically connected to said corresponding cathode electrode.

38. The field emission display of claim 26, wherein each said emitter comprises one of graphite, diamond, DLC (diamond-like carbon), $C_{60}$(Fullerene), and CNT (carbon nanotubes).

* * * * *